US006701817B2

(12) United States Patent
Cho

(10) Patent No.: US 6,701,817 B2
(45) Date of Patent: Mar. 9, 2004

(54) AUTOMATIC IRON CORE AIR GAP CUTTING APPARATUS

(76) Inventor: Albert Cho, 3F, No. 1, Lane 37, Ming-Yuan St., Sanchung City, Taipei Hsien (TW)

( * ) Notice: Subject to any disclaimer, the term of this patent is extended or adjusted under 35 U.S.C. 154(b) by 41 days.

(21) Appl. No.: 10/029,248

(22) Filed: Dec. 28, 2001

(65) Prior Publication Data

US 2003/0121392 A1 Jul. 3, 2003

(51) Int. Cl.[7] ..... B26D 3/06; B26D 5/28

(52) U.S. Cl. ..... 83/876; 83/207; 83/209; 83/211; 83/282; 83/364; 83/367; 83/437.3; 83/477.2

(58) Field of Search ..... 83/876, 160, 207, 83/209, 211, 437.3, 485, 907, 276

(56) References Cited

U.S. PATENT DOCUMENTS 2,428,493 A * 10/1947 Haller ..... 83/226
3,706,247 A * 12/1972 Clark ..... 83/24
3,901,115 A * 8/1975 Vizziello et al. ..... 83/449
3,994,326 A * 11/1976 Sarten ..... 144/136.1
4,164,248 A * 8/1979 Rysti ..... 144/356
4,175,458 A * 11/1979 Paris et al. ..... 83/268
5,014,583 A * 5/1991 Webb et al. ..... 83/76.9
5,044,240 A * 9/1991 Fischer et al. ..... 83/161
5,595,102 A * 1/1997 O'Grady ..... 83/435.17
5,694,823 A * 12/1997 Westra et al. ..... 83/147
6,209,431 B1 * 4/2001 Wickham ..... 83/165
6,360,638 B1 * 3/2002 White et al. ..... 83/13

* cited by examiner

*Primary Examiner*—Allan N. Shoap
(74) *Attorney, Agent, or Firm*—Birch, Stewart, Kolasch & Birch, LLP

(57) ABSTRACT

An automatic iron core air gap cutting apparatus includes an electronic control box and a transmission system to receive signals and control from the electronic control box for receiving finished iron cores to perform air gaps cutting operations. The completed iron cores with the air gaps formed thereon are pushed to an exit chute for packaging, thereby completing the automatic iron core fabrication process.

12 Claims, 10 Drawing Sheets

AUTOMATIC IRON CORE AIR GAP CUTTING APPARATUS

FIELD OF THE INVENTION

The present invention relates to an automatic iron core air gap cutting apparatus and particularly an apparatus for cutting air gaps of annular iron cores made of metal magnetic material such as a silicon steel sheet or nickel steel sheet.

BACKGROUND OF THE INVENTION

Conventional annular iron cores made of metal magnetic material such as a silicon steel sheet or nickel steel sheet should have an air gap for forming magnetic field. The air gap is made by placing a finished iron core on a selected air gap-cutting device (such as a lathe) to perform required machining processes. It is a complicated processing and cannot be made in a mass production fashion. The main problems are:

1. The air gap on the annular iron core formed by a specific air gap-cutting device must be done individually and manually. The processing is time-consuming and incurs a higher labor cost. The cutting device is also expensive and occupies a large floor area. As most iron core producers make only a limited quantity of iron core products these days, the cost burden becomes very heavy for the producers.
2. As cutting of the air gap is done manually, it is difficult to control the quality at a consistent level. The iron cores made by different workers often result in different quality, and are prone to produce greater product defects and product returns, and a lot of reworks are required.

SUMMARY OF THE INVENTION

The primary object of the invention is to resolve aforesaid disadvantages. The invention aims to provide an automatic iron core air gap cutting processing, which can automatically cutting and forming air gaps on iron cores. The cutting of the air gap on every iron core is done through calculations and central control of a computer. The invention includes an electronic control box and a transmission system to receive signals from the electronic control box for cutting air gaps on the iron cores. The finished iron cores are directly fed to the transmission system to perform air gap cutting. The completed iron cores with the air gaps are pushed to an exit chute for packaging and follow on processes. It is a fully automatic fabrication processing for making the iron cores.

The foregoing, as well as additional objects, features and advantages of the invention will be more readily apparent from the following detailed description, which proceeds with reference to the accompanying drawings.

DESCRIPTION OF THE PREFERRED EMBODIMENT

Figure 1A:
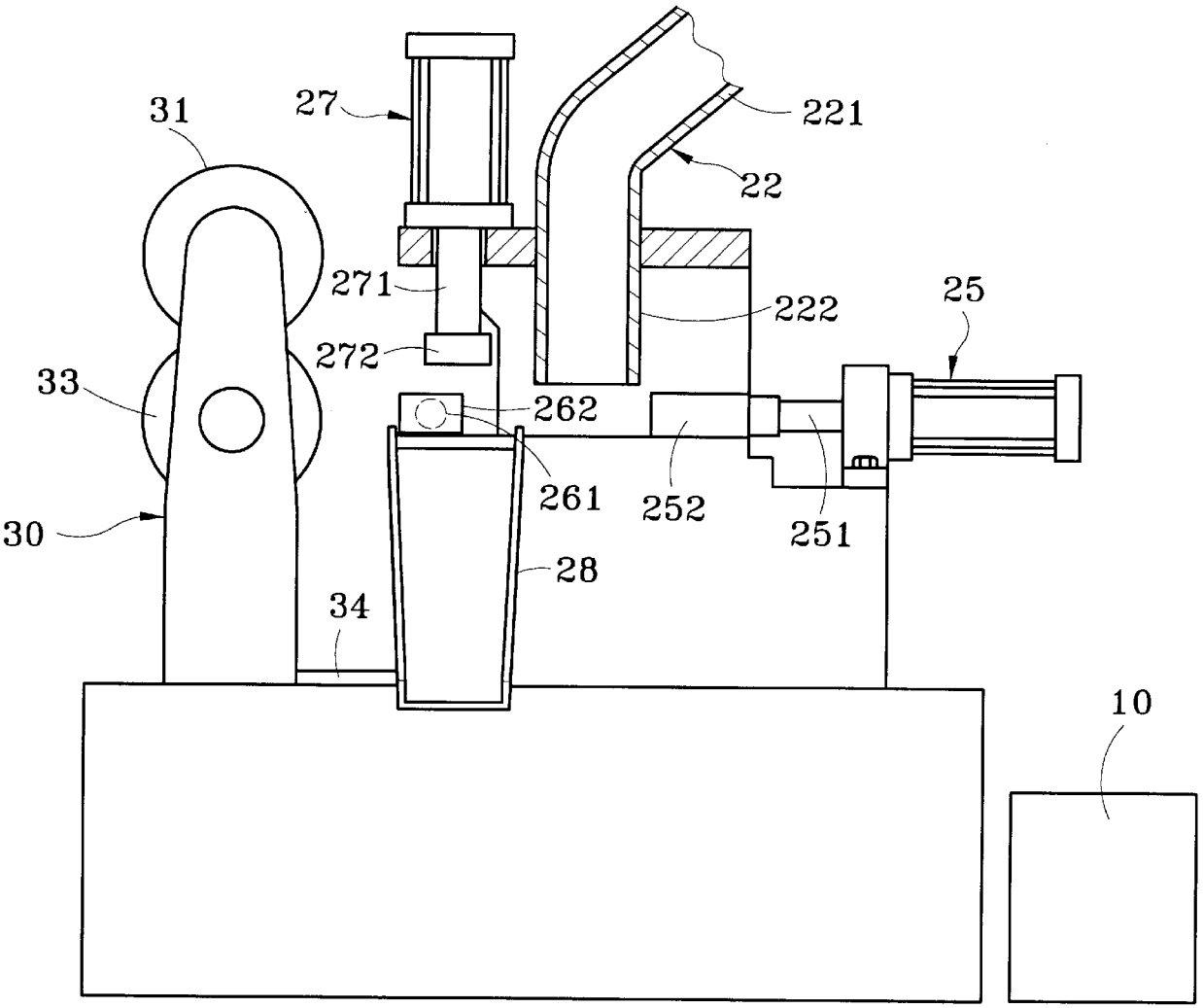
FIGS. 1A and 1B are schematic views of the invention at an initial condition.
Figure 1B:
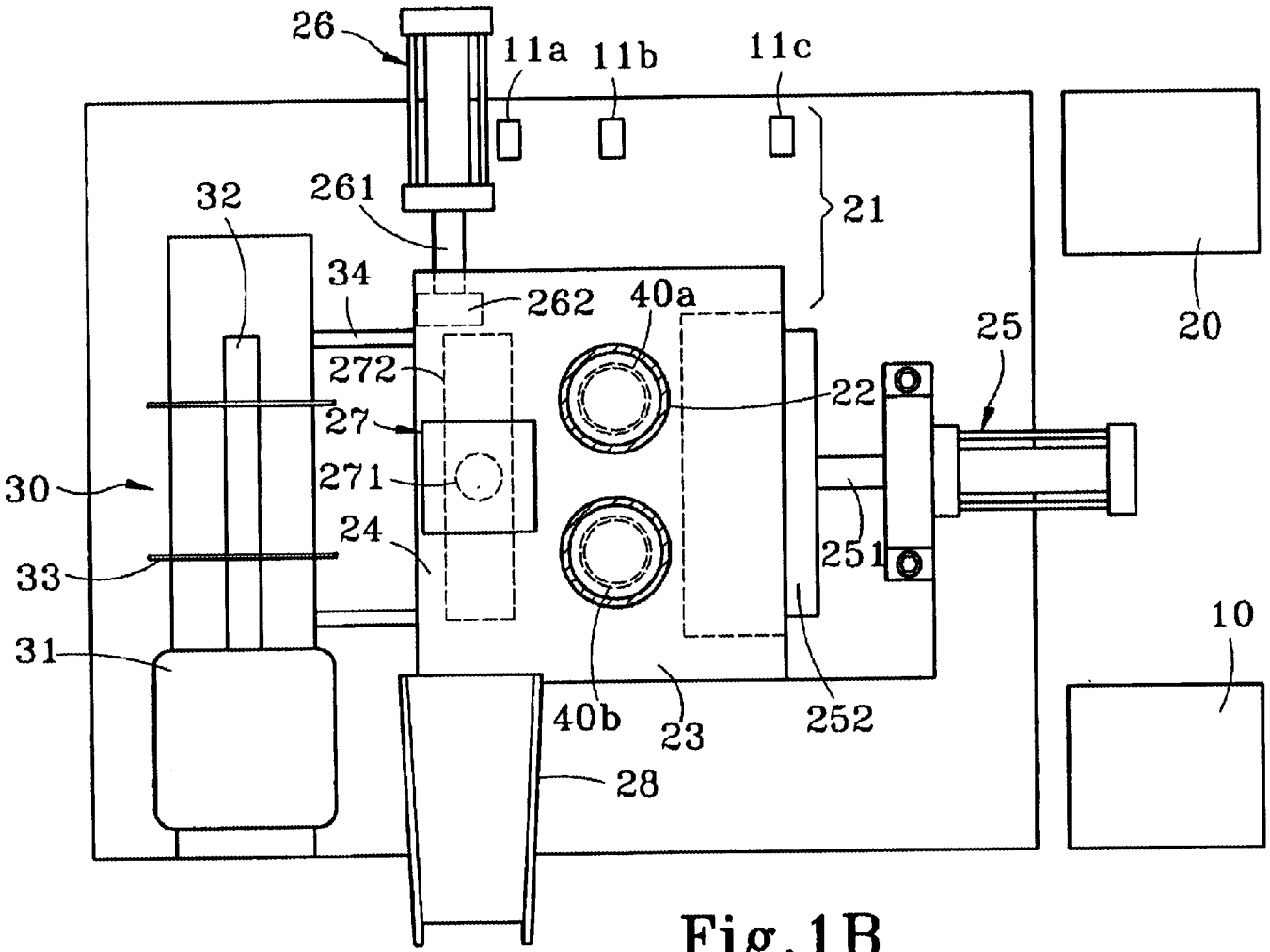
Figure 5:
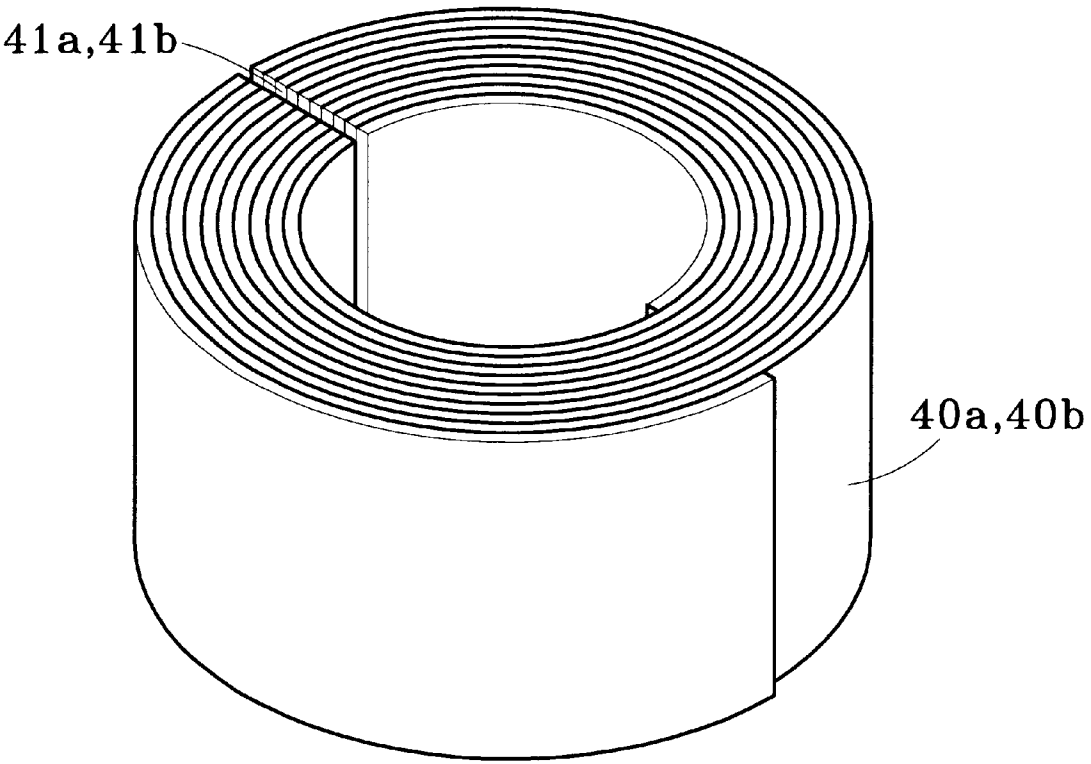
FIG. 5 is a perspective view of a finished iron core with an air gap.

Referring to FIGS. 1A, 1B and 5, the invention is an apparatus for automatically and respectively cutting an air gap 41*a*, 41*b* on iron cores 40*a*, 40*b* through an electronic control box 10 and a transmission system 20 which may receive signals from the control box 10. The transmission system 20 has a material holding area 21 for holding the iron cores 40*a*, 40*b* that are made of a metal magnetic material such as a silicon steel sheet or nickel steel sheet. In the material holding area 21, there is a chute 22 for carrying the iron cores 40*a*, 40*b*, a holding platform 23 located at the exit of the chute 22 and a machining platform 24 located at one side of the holding platform 23. The chute 22 includes a transporting passage 221 and a tube 222 located between the transporting passage 221 and the holding platform 23. On the holding platform 23, there is a first push device 25 for moving the iron cores 40*a*, 40*b* to the machining platform 24. On the machining platform 24, there is a cutting mechanism 30 which includes an electric driving device 31, a rotary shaft 32 driven by the electric driving device 31 and cutters 33 mounted on the rotary shaft 32 for cutting the air gaps 41*a*, 41*b* on the iron cores 40*a*, 40*b*.

Figure 2A:
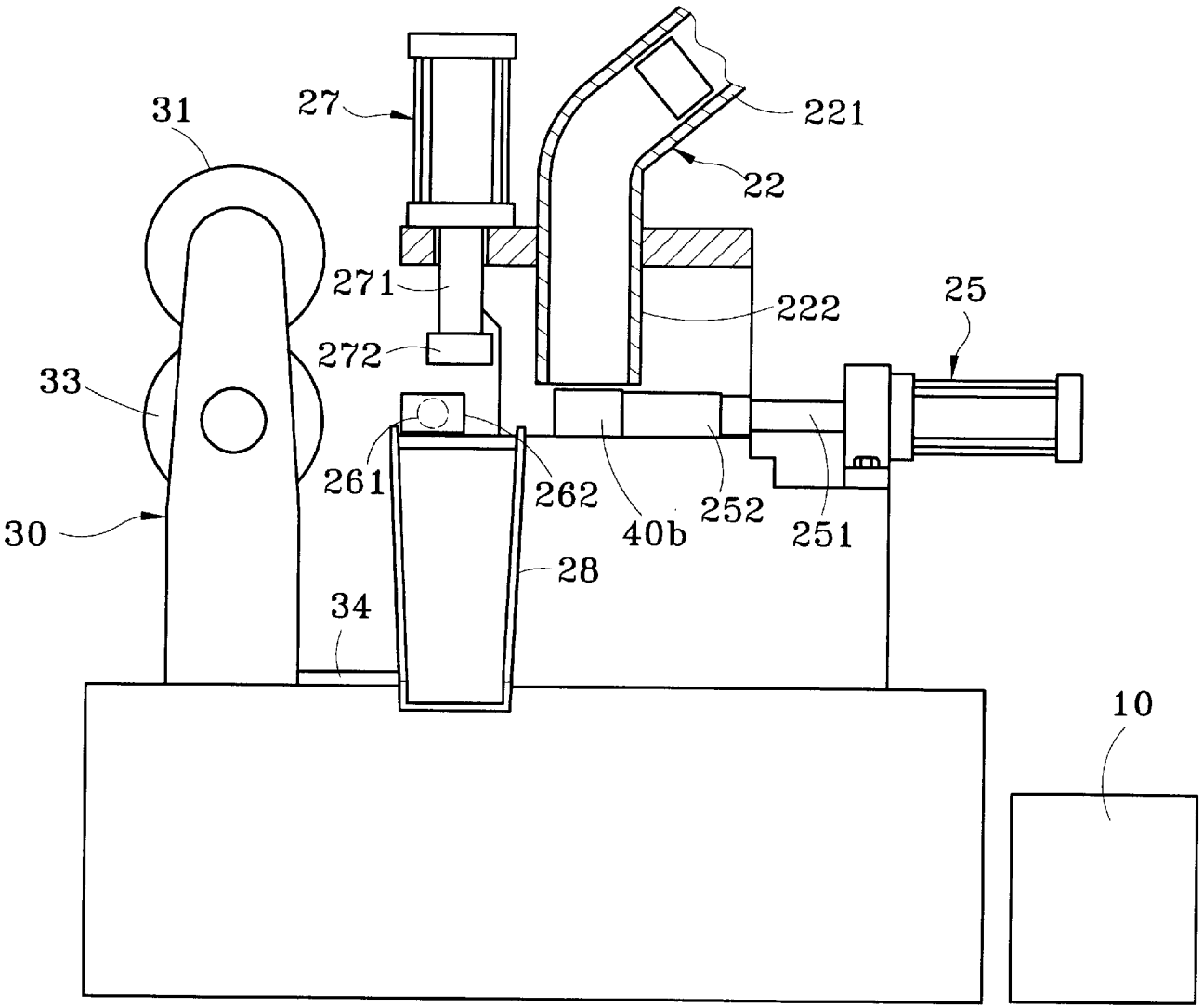
FIGS. 2A, 2B and 2C are schematic views of the invention, showing iron cores being transported to a machining platform.
Figure 2B:
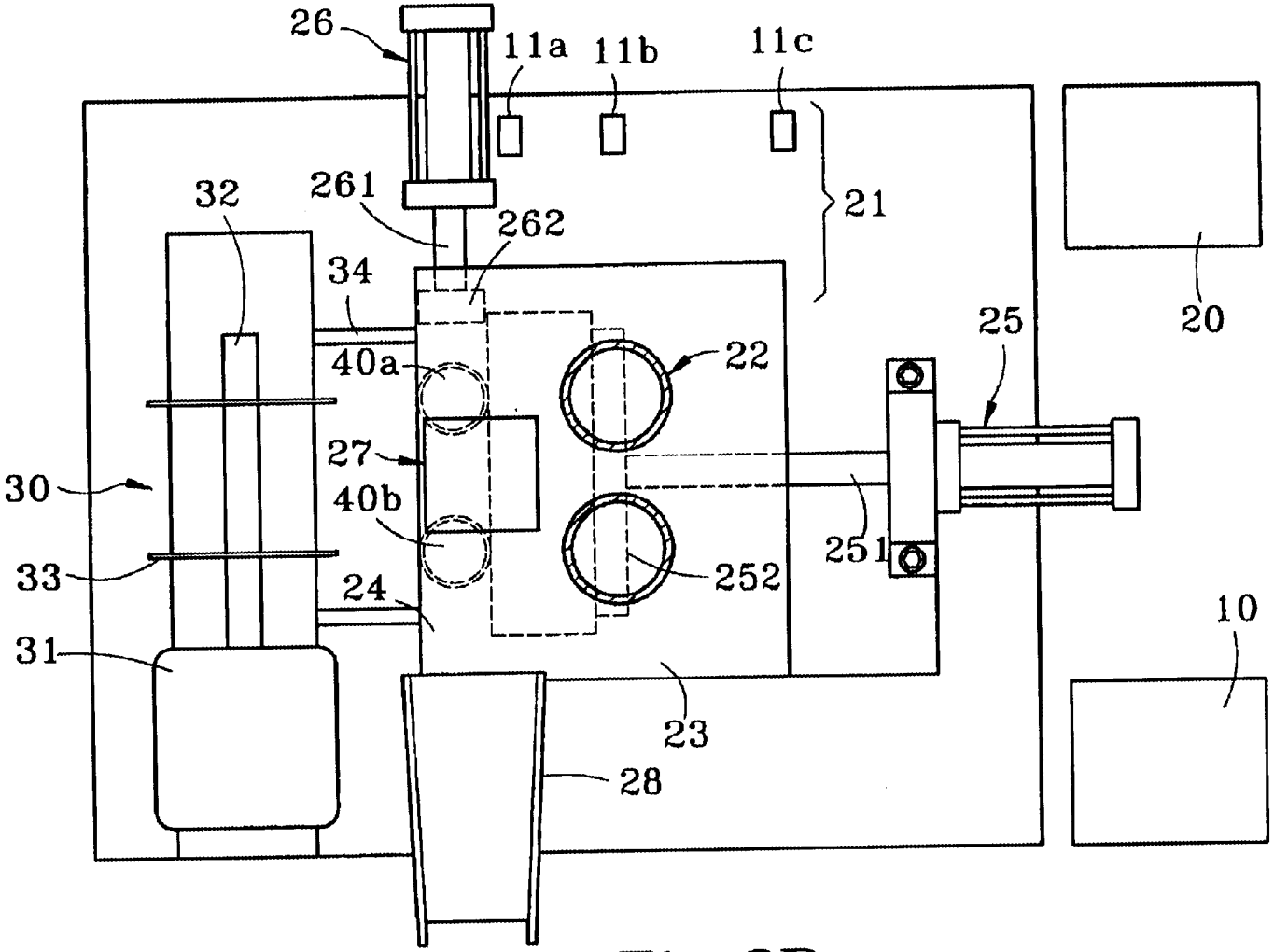

Referring to FIGS. 2A and 2B, the material holding area 21 further has a plurality of sensors 11*a*, 11*b* and 11*c* for detecting moving paths of the iron cores 40*a*, 40*b* and generating signals to the electronic control box 10. When the iron cores 40*a*, 40*b* are dropped to the holding platform 23 from the transporting passage 221 and tube 222, the sensor 11*b* on the material holding area 21 detects the iron cores 40*a*, 40*b* and generates signals to notify the electronic control box 10. The electronic control box 10 synchronously generates signals to activate the transmission system 20 to move the first push device 25. The first push device 25 has a first oil hydraulic rod 251 and a first push member 252 driven by the first oil hydraulic rod 251 to move the iron cores 40*a*, 40*b* towards the machining platform 24. When the iron cores 40*a*, 40*b* pass the sensor 11*a*, the sensor 11*a* detects and generates signals and transmits the signals to the electronic control box 10 for stopping the first push device 25, therefore the iron cores 40*a*, 40*b* may be positioned at the front end of the machining platform 24.

Figure 2C:
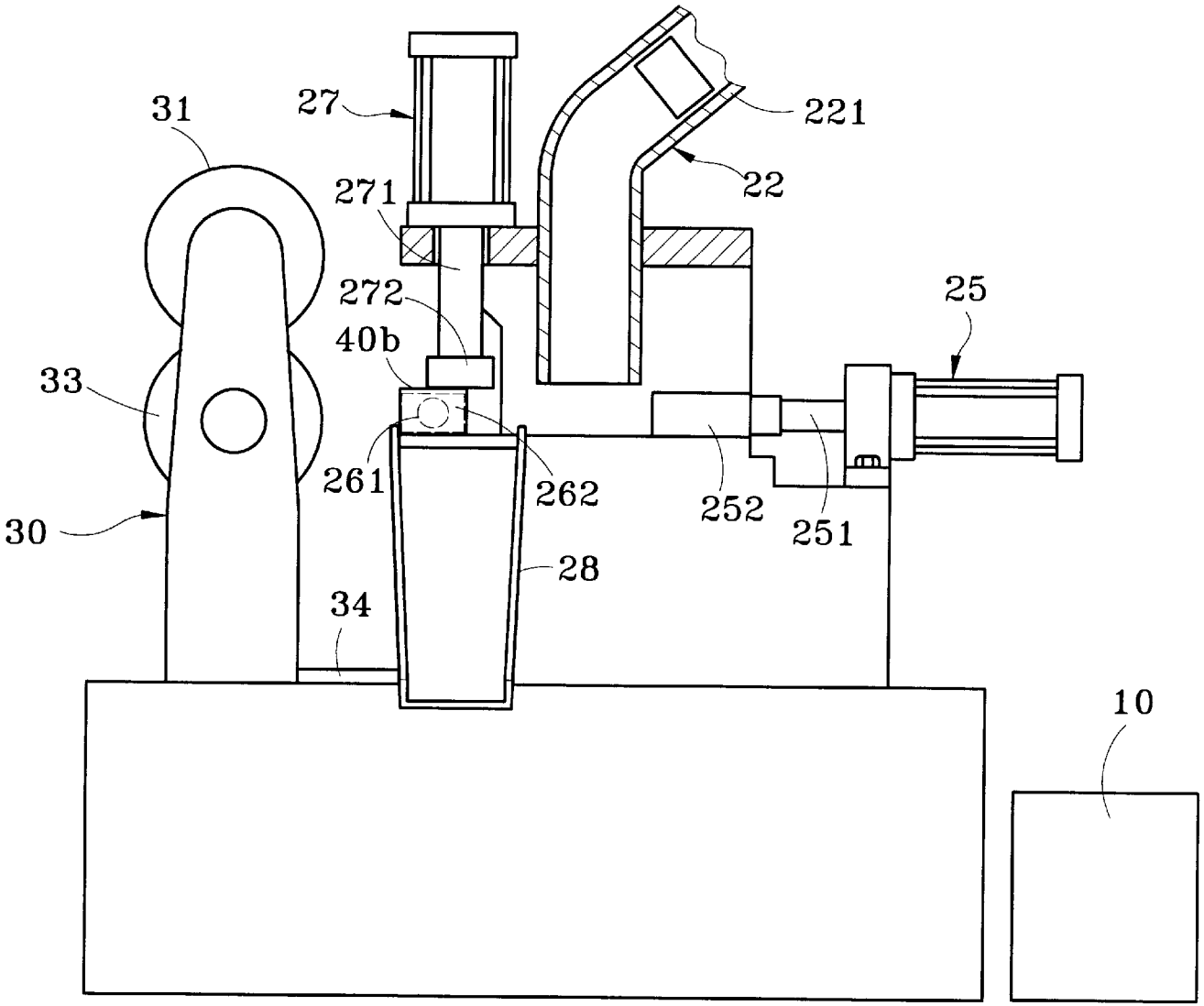

Referring to FIG. 2C, on the machining platform 24, there is an anchor device 27 for depressing and holding the iron cores 40*a*, 40*b* firmly without wobbling or skewing when the air gaps 41*a*, 41*b* are being cut and forming. The anchor device 27 has an anchor oil hydraulic rod 271 and a depressing member 272 driven by the anchor oil hydraulic rod 271. When the sensor 11*a* notifies the electronic control box 10 to stop the movement of the first push device 25, the electronic control box 10 simultaneously sends a signal to the transmission system 20 to activate the anchor device 27 to move down and depress and hold the iron cores 40*a*, 40*b* on selected positions. Through signals issued by the electronic control box 10, the anchor device 27 is moved down and the first push device 25 is stopped from moving forwards and returned to its original position.

Figure 3A:
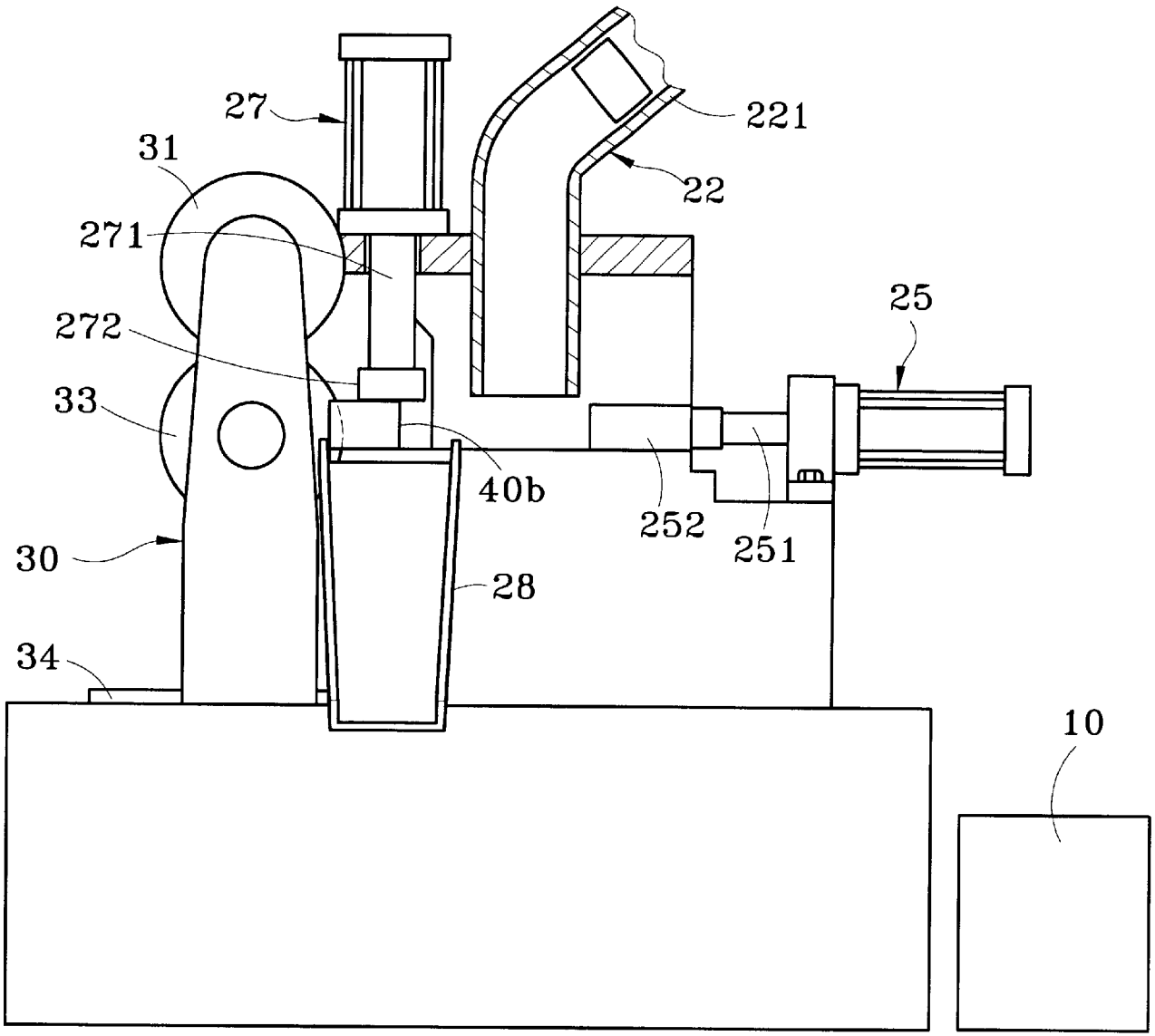
FIGS. 3A, 3B and 3C are schematic views of the invention, showing iron cores are under cutting operations.
Figure 3B:
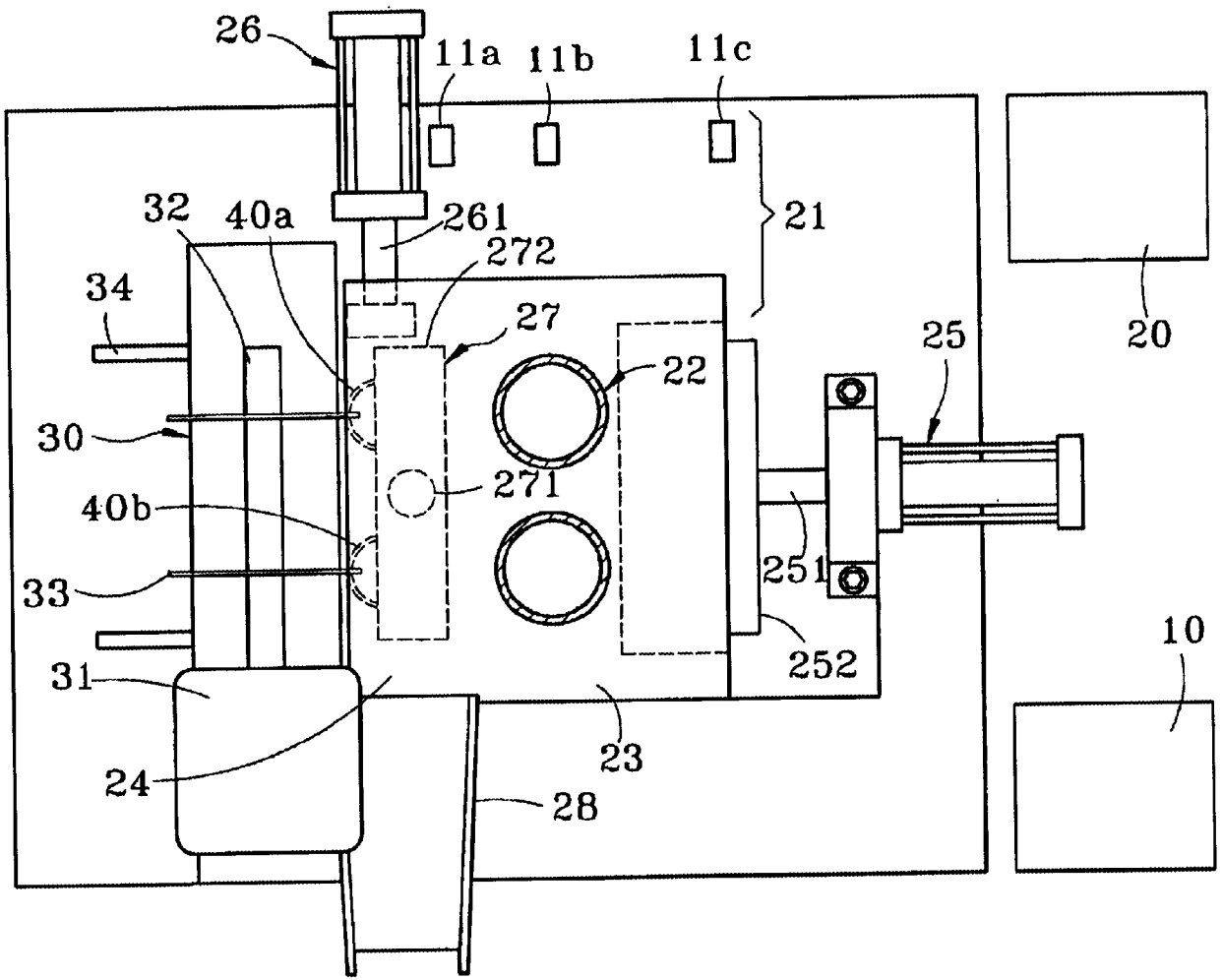
Figure 4:
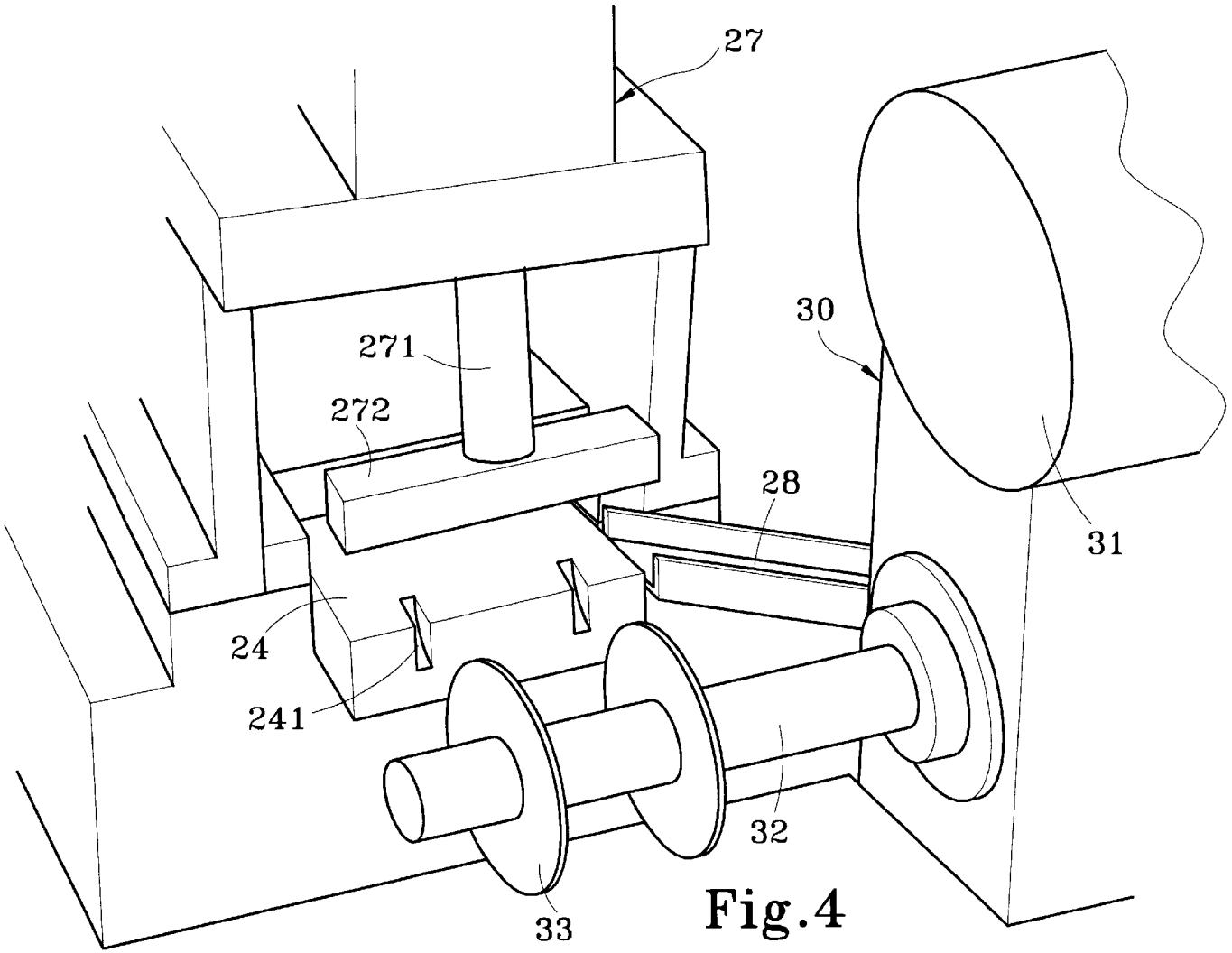
FIG. 4 is a schematic view of the invention, showing the machining platform and the cutting mechanism.

Referring to FIGS. 3A and 3B, when the first push device 25 passes the sensor 11*b*, the electronic control box 10 immediately issues signals to activate the cutting mechanism 30. There is a slide rail 34 located between the cutting mechanism 30 and the machining platform 24 to allow the cutting mechanism 30 moving to the machining platform 24 when receiving signals from the electronic control box 10. The electric driving device 31 of the cutting mechanism 30 is a motor. The cutters 33 mounted on the rotary shaft 32 are circular cutting blades. In order to facilitate cutting operation, the machining platform 24 has slots 241 (as shown in FIG. 4) corresponding to where the air gaps 41*a*, 41*b* are formed. Thus through the electronic control box 10, the iron cores 40*a*, 40*b* made of metal magnetic material such as a silicon steel sheet or nickel steel sheet my be cut to form air gaps 41*a*, 41*b* of a selected width and length. And after the cutting mechanism 30 finishes cutting operations, it can be returned through the slide rail 34 to its original location. The cutting time and cycle of the cutting mechanism 30 may also match the return displacement of the first push device 25. When the first push device 25 is passing the sensor 11*c*, a signal will be issued concurrently to move the cutting mechanism 30 to its original location through the slide rail 34.

Figure 3C:
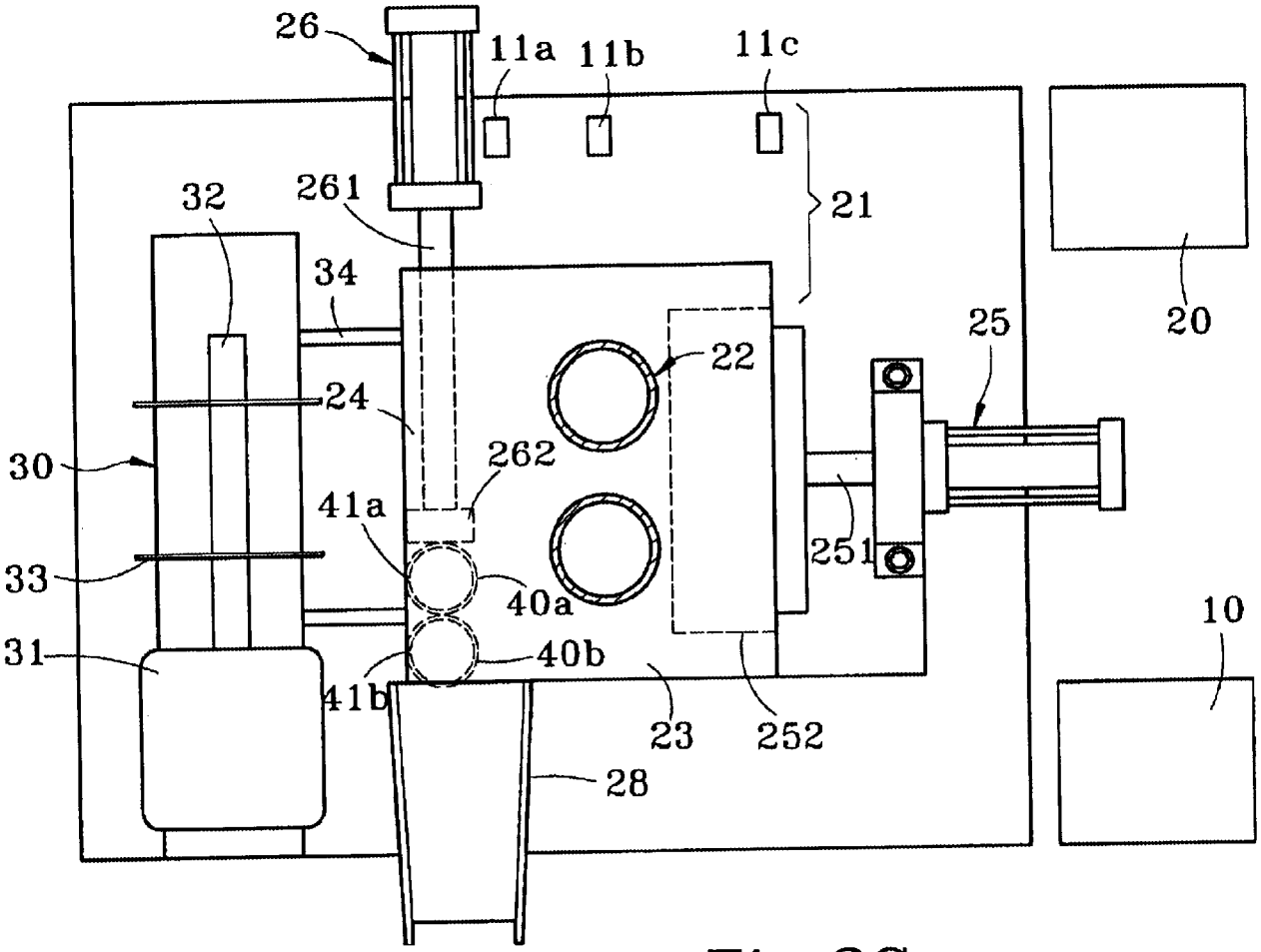

Referring to FIG. 3C, at one side of the machining platform 24, there is further a second push device 26 for moving the iron cores 40*a*, 40*b* which have completed machining and have the air gap 41*a*, 41*b* formed thereon. At another side of the machining platform 24, there is an exit chute 28 for receiving the completed iron cores 40*a*, 40*b*. The second push device 26 has a second oil hydraulic rod 261 and a second push member 262 driven by the second oil hydraulic rod 261. When the cutting mechanism 30 completes cutting operation and is returned to its original location, the electronic control box 10 issues a signal to the transmission system 20 to activate the second push device 26. The second oil hydraulic rod 261 will be driven to move the second push member 262 in a parallel displacement with the machining platform 24 to move the completed iron cores 40*a*, 40*b* which have air gaps 41*a*, 41*b* formed thereon from the machining platform 24 into the exit chute 28. Then the aforesaid operations for next cycle may be started again for cutting air gaps 41*a*, 41*b* on other iron cores 40*a*, 40*b*. By means of the construction and operations of the invention, a fully automatic air gap cutting processing may be accomplished.

As previous discussed, and referring to the accompanied drawings, it is clearly that the invention can achieve the following objects:

1. Cutting of the iron cores 40*a*, 40*b* is performed according to pre-set processes built in the electronic control box 10. It is done automatically without human labor as conventional techniques do. The air gaps 41*a*, 41*b* formed on the iron cores 40*a*, 40*b* can be centrally controlled and maintained at a consistent quality level, thus can improve production yield and increase economic value.
2. One or two or more iron cores 40*a*, 40*b* may be cut concurrently to form air gaps 41*a*, 41*b* desired depends on the number of the chute 22 and cutters 33. Change of these numbers is relatively simple. Hence the invention may be adapted to mass production easily to greatly shorten fabrication time of the iron cores 40*a*, 40*b*.
3. The width of the air gaps 41*a*, 41*b* may be changed by replacing cutters 33 of a selected width, and may be done easily. This also helps automatic cutting operations for forming the air gaps 41*a*, 41*b* of desired widths on the iron cores 40*a*, 40*b*.

What is claimed is:

1. An automatic iron core air gap cutting apparatus, comprising:

an electronic control box; and a transmission system to receive signals from the electronic control box for cutting air gaps on iron cores;

wherein the transmission system includes:

a material holding area for holding the iron cores, a chute for carrying the iron cores having an exit, a holding platform located at the exit of the chute and a machining platform located at one side of the holding platform;

a first push device located on the holding platform for moving the iron cores to the machining platform; and a cutting mechanism including an electric driving device, a rotary shaft driven by the electric driving device and cutters mounted on the rotary shaft for cutting the air gaps on the iron cores.

2. The automatic iron core air gap cutting apparatus of claim 1, wherein the machining platform has an anchor device for depressing and holding the iron cores.

3. The automatic iron core air gap cutting apparatus of claim 1, wherein the machining platform has a second push device located on one side thereof for pushing the iron cores which have completed machining and have the air gaps formed thereon, and an exit chute located on another side thereof for receiving the iron cores pushed by the second push device.

4. The automatic iron core air gap cutting apparatus of claim 1, wherein the second push device includes a second oil hydraulic rod and a second push member driven by the second oil hydraulic rod.

5. The automatic iron core air gap cutting apparatus of claim 1, wherein the chute includes a transporting passage for carrying the iron cores and a tube located between the transporting passage and the machining platform.

6. The automatic iron core air gap cutting apparatus of claim 1 further having a slide rail located between the cutting mechanism and the machining platform to allow the cutting mechanism moving to the machining platform to perform cutting operations of the air gaps.

7. The automatic iron core air gap cutting apparatus of claim 1, wherein the transmission system is an oil hydraulic server system.

8. The automatic iron core air gap cutting apparatus of claim 1, wherein the transmission system includes a plurality of sensors located on the material holding area for detecting iron cores moving paths to generate signals to the electronic control box.

9. The automatic iron core air gap cutting apparatus of claim 1, wherein the first push device includes a first oil hydraulic rod and a first push member.

10. The automatic iron core air gap cutting apparatus of claim 1, wherein the electric driving device is a motor.

11. The automatic iron core air gap cutting apparatus of claim 1, wherein the cutters are circular cutting blades.

12. The automatic iron core air gap cutting apparatus of claim 1, wherein the machining platform has slots formed at locations corresponding to where the air gaps are cut and formed.

* * * * *